US009776415B2

(12) United States Patent
Horrocks

(10) Patent No.: US 9,776,415 B2
(45) Date of Patent: Oct. 3, 2017

(54) SYSTEM FOR REMOVING CONDENSATION FROM PRINTHEAD ASSEMBLY

(71) Applicant: Memjet Technology Ltd., Dublin (IE)

(72) Inventor: Glenn Horrocks, North Ryde (AU)

(73) Assignee: Memjet Technology Limited (IE)

( * ) Notice: Subject to any disclaimer, the term of this patent is extended or adjusted under 35 U.S.C. 154(b) by 0 days.

(21) Appl. No.: 15/187,675

(22) Filed: Jun. 20, 2016

(65) Prior Publication Data

US 2016/0368271 A1 Dec. 22, 2016

Related U.S. Application Data

(60) Provisional application No. 62/181,981, filed on Jun. 19, 2015.

(51) Int. Cl.
*B41J 2/165* (2006.01)
*B41J 11/00* (2006.01)

(52) U.S. Cl.
CPC ..... *B41J 2/16535* (2013.01); *B41J 2/16544* (2013.01); *B41J 2/16585* (2013.01); *B41J 11/0085* (2013.01); *B41J 2002/1655* (2013.01)

(58) Field of Classification Search
None
See application file for complete search history.

(56) References Cited

U.S. PATENT DOCUMENTS

2003/0189614 A1* 10/2003 Steinfield ..... B41J 2/16517 347/22
2008/0266342 A1* 10/2008 Steinfield ..... B41J 2/16535 347/14
2013/0084397 A1* 4/2013 Erickson ..... B41J 2/14024 427/369

* cited by examiner

*Primary Examiner* — Lisa M Solomon
(74) *Attorney, Agent, or Firm* — Cooley LLP

(57) ABSTRACT

A printer includes: a platen; a printhead assembly having an inkjet printhead operatively positioned opposite the platen; a feed mechanism for feeding a web of print media over the platen and along a printing feed path; and a diverter configured for periodically diverting a portion of the web towards the printhead assembly and along a maintenance feed path. The portion of the web diverted along the maintenance feed path wipes part of the printhead assembly and removes condensation.

19 Claims, 2 Drawing Sheets

SYSTEM FOR REMOVING CONDENSATION FROM PRINTHEAD ASSEMBLY

CROSS-REFERENCE TO RELATED APPLICATIONS

The present application claims the benefit of priority under 35 U.S.C. §119(e) of U.S. Provisional Application No. 62/181,981, entitled SYSTEM FOR REMOVING CONDENSATION FROM PRINTHEAD ASSEMBLY, filed on Jun. 19, 2015, the contents of which are hereby incorporated herein by reference for all purposes.

FIELD OF THE INVENTION

This invention relates to a system for removing condensation from part of a printhead assembly. It has been developed primarily to enable continuous print runs with less frequent maintenance interventions.

BACKGROUND OF THE INVENTION

The Applicant has previously described a number of different wiping systems for wiping nozzle plates of pagewide printheads. Wiping interventions are typically required when printouts deteriorate in print quality. For example, the nozzle plate may become contaminated with flooded ink or the nozzle plate may become contaminated with particulates (e.g. paper dust), which require periodic removal to maintain optimal print quality.

Printhead wiping may be either along a longitudinal extent of the printhead (see, for example, WO2013/059853) or transversely across the printhead (see, for example, WO2011/143699). Usually, printhead wiping is sufficient to recover print quality; however, periodic wiping is undesirable in some types of printers.

In a digital inkjet press, a web of print media is fed continuously past one or more fixed printheads at very high speeds (e.g. greater than 30 inches per second). An example of a digital inkjet press is described in U.S. Pat. No. 8,616,678, the contents of which are incorporated herein by reference. Since the web cannot be broken, in order to wipe printheads in a digital inkjet press of the type described in U.S. Pat. No. 8,616,678, the printheads must be lifted away from the web of print media and positioned adjacent corresponding wipers. Once the printheads have been wiped, the printheads are lowered back to a printing position so that printing may be resumed. This wiping operation typically takes 20 seconds or more and necessarily requires the web feed mechanism to be stopped during wiping; otherwise, dozens of feet of the print media are wasted for each wiping intervention.

However, stopping the web feed mechanism is undesirable in a high speed press. Web feed mechanisms are designed to run continuously for long periods—stopping the press for frequent maintenance interventions has a very significant effect on overall print speeds, interferes with the operation of downstream web cutters, and ultimately affects the economic feasibility of installing the digital web press.

At high print speeds, a common type of print defect is caused by condensation of water vapor on parts of the printhead assembly. Referring to FIG. 1, there is shown a printer 1 wherein a web 3 of print media is fed over an apertured platen surface 6 past a printhead 7 in the direction indicated by the arrow D at a speed of about 55 inches per second (ips). The region 10 immediately downstream of the printhead 7 has a relatively high humidity. Sources of water vapor in the region 10 include: hot ink droplets in flight which are ejected from the printhead 7, ink droplets striking the web and evaporating; and thermal ink ejection processes in the printhead 7, whereby aqueous ink is superheated in firing chambers and vapor bubbles are vented through inkjet nozzles.

Water vapor in the region 10 will tend to condense on any cool surface in the vicinity. Although the printhead 7 itself is hot during printing, the printhead assembly 12, on which the printhead is mounted, is relatively thermally isolated from the printhead and therefore remains relatively cool. Hence, relatively cool parts of the printhead assembly 12 downstream of the printhead 7 collect condensation 13 during printing, and this condensation accumulates over time. In a Memjet® printhead assembly 12, shown schematically in FIG. 1, condensation 13 usually accumulates on the lower surface of an encapsulant material 14 positioned immediately downstream of the printhead 7. The encapsulant material 14 is typically a polymer, which encapsulates wirebond connectors supplying power and data to the printhead.

Condensation on the surface of the printhead assembly 12 is problematic for print quality in two respects. Firstly, the condensate 13 may drip from the surface directly onto the web 3 and cause mottling of the printout. Secondly, and more significantly, the condensate 13 may migrate back onto the nozzle plate 15 of the printhead via capillary action. If water droplets reach the nozzle plate 15, they are quickly sucked into inkjet nozzles due to backpressure in the ink delivery system supplying ink to the printhead. Hence, inkjet nozzle chambers and ink supply channels in the printhead 7 may become filled with water instead of ink. If a group of nozzles print water instead of ink, this has a severe effect on print quality until the water is cleared from the printhead via a number of droplet ejections. At high print speeds, the effects of condensation are typically manifested in streaks in the printout.

It would therefore be desirable to provide a means for mitigating the effects of condensation during high speed printing. It would be further desirable to provide a method of wiping a printhead assembly, which does not require either stopping or breaking the web.

SUMMARY OF THE INVENTION

In a first aspect, there is provided a printer comprising:

a platen;

a printhead assembly comprising at least one inkjet printhead operatively positioned opposite the platen;

a feed mechanism for feeding a web of print media over the platen and along a printing feed path; and a diverter configured for periodically diverting a portion of the web towards the printhead assembly and along a maintenance feed path, wherein the portion of the web diverted along the maintenance feed path wipes part of the printhead assembly.

The present invention advantageously provides a means of mitigating the effects of condensation build-up on the printhead assembly during printing. The web itself is used to wipe part of the printhead assembly by periodically diverting a portion of the web along an alternative maintenance feed path. It is particularly advantageous that the web does not need to be stopped or broken for this type of maintenance intervention. Therefore, the feed mechanism can continue to run without interruption, as well as other downstream web processing equipment (e.g. cutters, splicers, driers etc.).

The printhead assembly may comprise one printhead or a plurality of printheads, as described in, for example, U.S. Pat. No. 8,616,678. Likewise, the printhead assembly may comprise one printhead cartridge or a plurality of printhead cartridges installed in a printhead chassis. Each printhead is preferably fixed relative to the moving web during printing so that printing is performed in a single pass. Typically, each printhead comprises a plurality of printhead integrated circuits, which extend across a width of the web. Butted and staggered overlapping arrangements of printhead ICs in pagewide inkjet printheads will be readily apparent to the person skilled in the art.

The diverted portion of the web used for wiping may contact part of the printhead assembly. Alternatively, the diverted portion of the web used for wiping may be brought into sufficient proximity to the printhead assembly so as to wipe away condensation without the web itself contacting the printhead assembly. It will therefore be appreciating that both 'contact wiping' and 'non-contact wiping' are within the ambit of the present invention.

Preferably, the diverted portion of the web wipes a lowermost part of the printhead assembly, which is immediately downstream of a respective printhead. The lowermost part of the printhead assembly may comprise an encapsulant material which encapsulates data and power connectors (e.g. wirebond connectors) for the printhead.

Preferably, diverted portion of the web does not contact a nozzle plate of the printhead. Usually, it is preferable to avoid contact between the web and the nozzle plate so as to avoid depriming inkjet nozzles and/or damaging the nozzle plate. However, in some embodiments the diverted portion of the web may contact the nozzle plate of the printhead so as to wipe flooded ink from the printhead.

The diverter may be a mechanical diverter, such as a retractable guide, which guides the web along the alternative maintenance feed path.

In one preferred embodiment the platen comprises a plenum chamber having an apertured platen surface; and the diverter comprises a gas source connected to the plenum chamber and a controller configured for periodically providing a pulse of positive gas pressure from the gas source to the plenum chamber, wherein the pulse of positive gas pressure is sufficient to lift the portion of the web away from the platen surface and divert the portion of the web along the maintenance feed path.

Preferably, the printer comprises a vacuum source connected to the plenum chamber. Applying suction through the platen surface is typical in high speed printing.

Preferably, the controller is configured for periodically interrupting a vacuum pressure in plenum chamber with the pulse of positive gas pressure.

Preferably, the controller is configured for providing the pulse of positive gas pressure with a predetermined pulsewidth and/or frequency.

Typically, the predetermined period and frequency is determined by one or more of:

a type of print media;

a speed of printing;

an image to be printed;

an ambient humidity;

an ambient temperature; and a type of ink supplied to the printhead.

Preferably, the predetermined period is in the range of 0.05 to 0.8 seconds, or preferably 0.1 to 0.6 seconds.

The predetermined frequency may be defined in terms of a time period or print length. For example, the predetermined frequency may be in the range of every 5 to 100 seconds (i.e. 0.2 to 0.01 Hz). Alternatively, the predetermined frequency may be, for example, in the range of every 30 to 500 feet of printing.

Of course, the predetermined period and frequency may be interdependent. For example, if positive pressure is applied with a relatively high frequency, then the period of applying the pressure may be relatively shorter since an amount of condensation build up will be relatively small. Conversely, if positive pressure is applied with a relatively lower frequency, then the period of applying the pressure may be relatively longer since an amount of condensation build up will be relatively large.

Preferably, the feed mechanism continuously feeds the web past the printhead when the positive gas pressure is applied to the plenum chamber. Typically, the feed mechanism feeds the web at a same speed used for printing (e.g. at least 30 inches per second) when the positive gas pressure is applied to the plenum chamber.

A distance between the platen surface and a nozzle plate of the printhead is typically in the range of 0.2 to 1 mm. Correspondingly, a maximum distance by which the web is lifted from the platen surface is typically in the range of 0.2 to 1 mm. Generally, the web is lifted by less than the pen-paper-spacing (PPS) so as to avoid contact with the nozzle plate.

The vacuum source and gas source may be connected to the plenum chamber by any suitable means. In one embodiment, the vacuum source and gas source may be a same vacuum pump, which is reversed to provide positive air pressure to the plenum chamber when required.

In another embodiment, the plenum chamber may be connected independently to a vacuum pump and a separate gas source (e.g. air compressor) via dedicated vacuum and gas ports in the plenum chamber. With the vacuum pump still running, the air compressor may provide sufficient pressure to overcome the vacuum pressure in the plenum chamber and, hence, provide sufficient positive gas pressure to lift the web towards the printhead assembly.

In a preferred embodiment, a vacuum pump and an air compressor are connected to the plenum chamber via a multiway valve (e.g. three-way valve), with the controller controlling the valve so that the plenum chamber is connected either to the vacuum pump or the air compressor.

These and other means for providing a vacuum pressure and a positive gas pressure to the plenum chamber will be readily apparent to the person skilled in the art.

In a second aspect, there is provided a method of wiping a portion of a printhead assembly, the method comprising the steps of:

feeding a web of print media over a platen, the printhead assembly comprising at least one inkjet printhead positioned opposite the platen; and periodically diverting a portion of the web towards the printhead assembly and along a maintenance feed path, wherein the portion of the web diverted along the maintenance feed path wipes part of the printhead assembly.

Preferably, the platen comprises a plenum chamber having an apertured platen surface, and the step of diverting the portion of the web comprises periodically applying a pulse of positive gas pressure to the plenum chamber so as to lift the portion of the web away from the platen surface and divert the portion of the web along the maintenance feed path.

Other preferred features of the invention, as described above in connection with the first aspect, are, of course, applicable to the second aspect.

BRIEF DESCRIPTION OF THE DRAWINGS

A specific embodiment of the present invention will now be described by way of example only with reference to the accompanying drawings, in which.

DETAILED DESCRIPTION OF THE INVENTION

Figure 1:
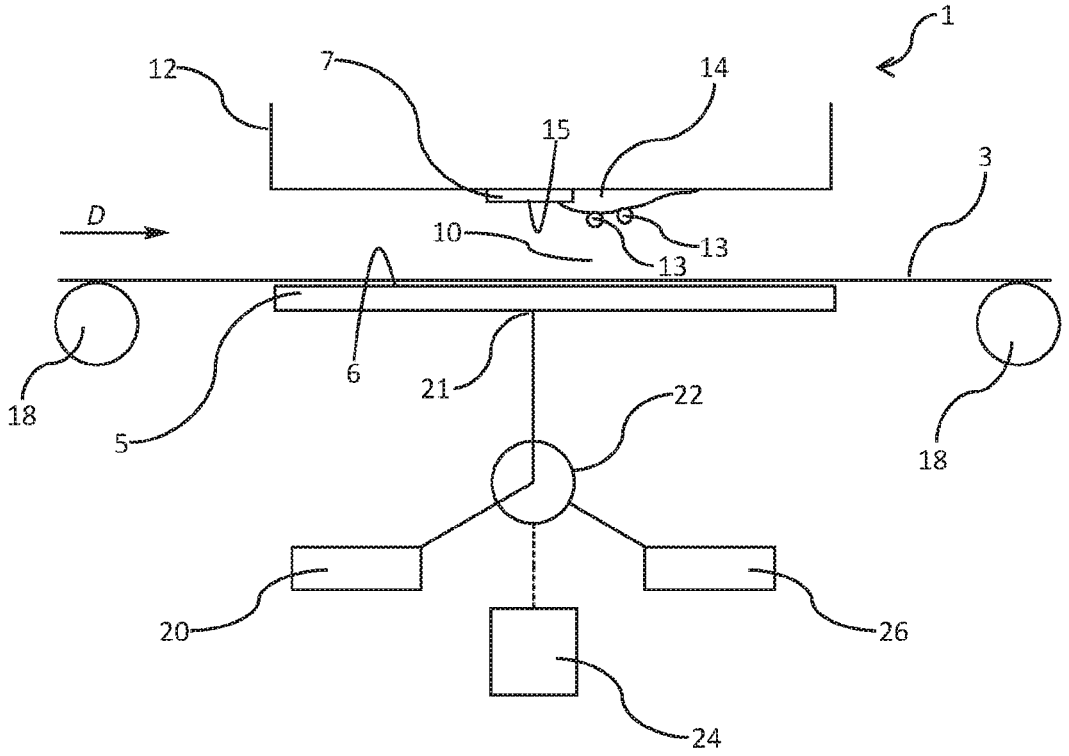
FIG. 1 is a schematic view of a printer according to the present invention during normal printing.
Figure 3:
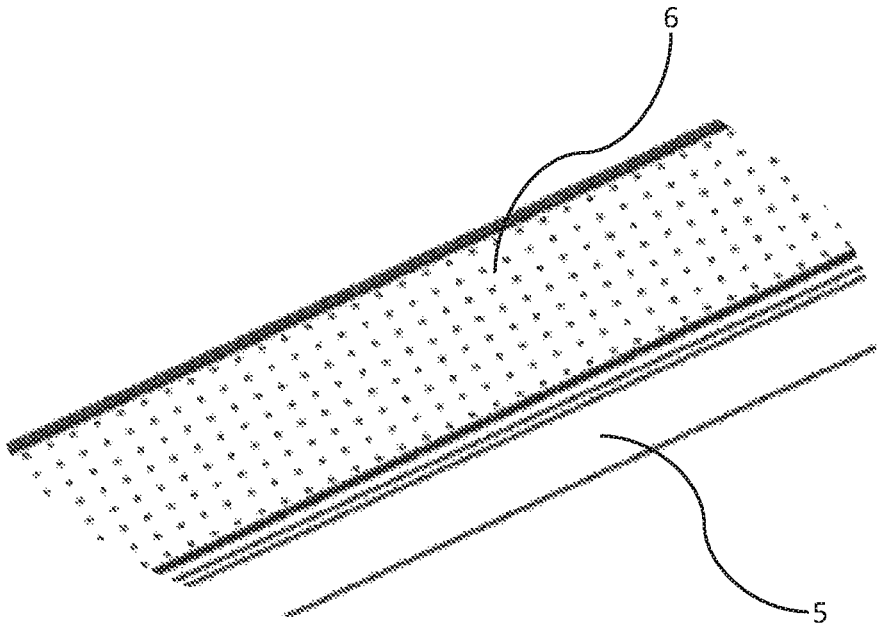
FIG. 3 is a partial perspective view of a plenum chamber.

Referring to FIG. 1, there is shown schematically a printer 1 comprising a plenum chamber 5 having an apertured platen surface 6 and a printhead assembly 12. The printhead assembly comprises a printhead 7, which is operatively positioned opposite the platen surface 6 for printing. The printhead assembly 12 may take the form of a replaceable printhead cartridge, such as the Memjet® printhead cartridge described in U.S. Pat. No. 8,025,383, the contents of which are herein incorporated by reference. Furthermore, a plurality of printhead cartridges (e.g. monochrome printhead cartridges) may be positioned opposite the platen surface 6, as described in U.S. Pat. No. 8,616,678. Plenum chambers are well known in the inkjet printing art and typically take the form of a vacuum platen. By way of completeness, U.S. Pat. No. 8,616,678 describes a suitable plenum chamber having an apertured upper platen surface and one or more ports for connection to a vacuum source. FIG. 3 also shows an example of a suitable plenum chamber 5 for use in the present invention.

A feed mechanism, comprising rollers 18 positioned at either side of the plenum chamber 5, feeds the web 3 of print media over the platen surface 6 of the plenum chamber 5 in the direction indicated by arrow D. During normal printing of an image, a gas port 21 of the plenum chamber 5 is connected to a vacuum pump 20 via a three-way valve 22. Accordingly, the web 3 normally experiences a suction force through the apertured platen surface 6 of the plenum chamber 5 during printing, which positionally stabilizes the web relative to the printhead 7 for high quality printing. The web 3 is fed over the platen surface 6 along a printing feed path during normal printing.

As explained above, ink droplets ejected from the printhead 7 create a region 10 of relatively high humidity immediately downstream of the printhead. Water vapor in this region 10 tends to condense on relatively cool surface(s) of the printhead assembly 12. In the case of the printer 1, the relatively cool surface is predominantly the lower surface of an encapsulant material 14, which protects wirebonds supplying power and data to the printhead 7. Condensed water droplets 13 collect on the lower surface of the encapsulant material 14 over time during printing and may migrate onto a nozzle plate 15 of the printhead 7 via capillary forces. These water droplets 13 have a deleterious effect on print quality, especially if they reach the nozzle plate 15, by dilution of ink in inkjet nozzle chambers.

Figure 2:
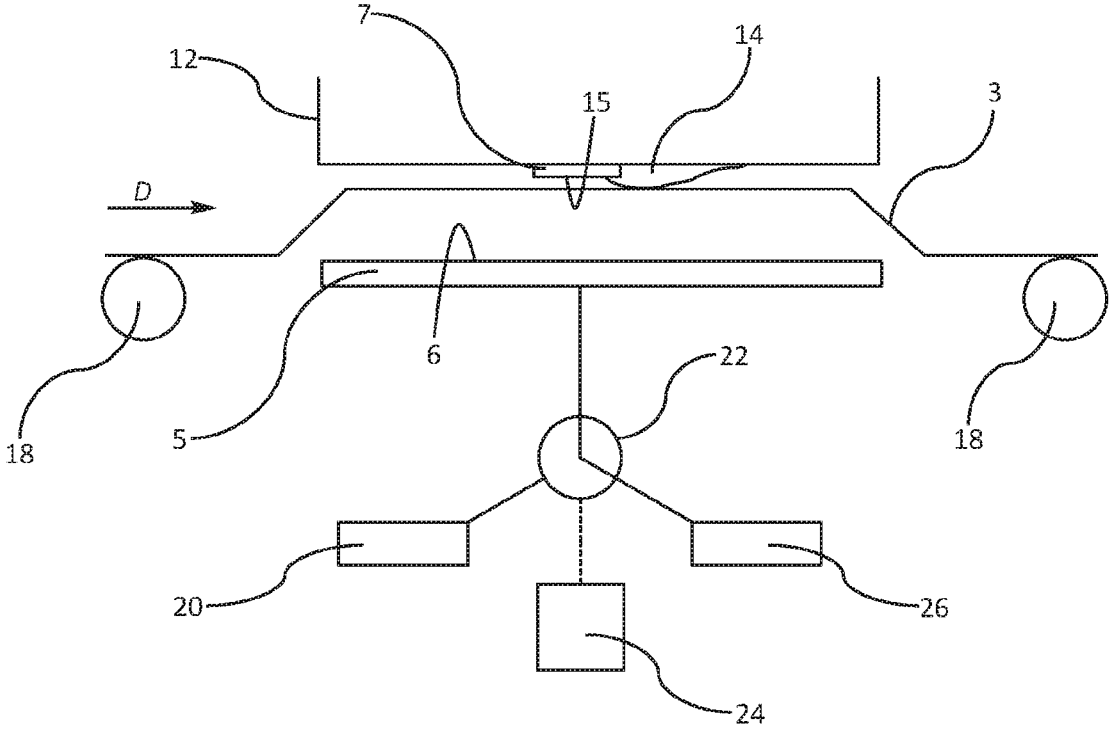
FIG. 2 is the printer shown in FIG. 1 during wiping.

Turning now to FIG. 2, the printer 1 is shown in a configuration for removing condensation. A controller 24 controlling the three-way valve 22 has now connected the plenum chamber 5 to an air compressor 26 such that the apertured platen surface 6 experiences a positive air pressure. The positive air pressure lifts a portion of the web 3 away from the platen surface 6 so that the portion of the web is diverted along a maintenance feed path, whereby the web wipes a lower surface of the encapsulant material 14. Accordingly, the controller 24, air compressor 26 and plenum chamber 5 cooperate to function as a diverter for diverting the web along the maintenance feed path.

The web 3 may lightly contact the encapsulant material 14, or the web may be lifted in sufficient proximity to collect water droplets without actually contacting the encapsulant material.

When the web is lifted from the platen surface 6, as shown in FIG. 2, the condensed water droplets 13 accumulated on the encapsulant material 14 are wiped away. The positive air pressure is provided in the form of a relatively short pulse (e.g. less than about 0.8 seconds). Furthermore, interruption of the vacuum pressure with the pulse of positive air pressure is usually timed such that the portion of the web 3 contacting the water droplets 13 does not contain part of a printed image. Switching from a vacuum pressure to a positive air pressure is performed with sufficient frequency to minimize any unpredictable deterioration in image quality (e.g. streaks) caused by the condensed water droplets 13. For example, the positive air pressure may be applied every 50 feet of printing for about 0.1 seconds when printing at 55 inches per second. Optimum timing of the positive air pressure may be determined empirically depending on, for example, the print speed, the type of print media (e.g. weight, porosity etc), the image to be printed (e.g. high density or low density image), an ambient humidity, an ambient temperature or the type of ink supplied to the printhead.

As shown in FIG. 2, the positive air pressure is controlled so that it is sufficient to lift the web 3 into contact with the encapsulant material 14, but insufficient to lift the web into potentially damaging contact with the nozzle plate 15 of the printhead 7. The optimum amount of positive of air pressure required may depend, for example, on the weight and porosity of the print media.

Once the web 3 has been lifted from the platen surface 6 to wipe the condensed water droplets 13 from the encapsulant material 14, the controller 24 configures the three-way valve 22 so that the vacuum pump 20 is re-connected to the plenum chamber 5. Thus, the web 3 lowers back into contact with the platen surface 6 (FIG. 1) and printing of the image may resume.

From the foregoing, it will be appreciated that the present invention provides a highly effective means for wiping condensation from a printhead assembly without requiring intervention from a dedicated maintenance assembly, and without requiring the web 3 to be broken or stopped. Simply by apportioning predetermined breaks in the printed image for web-wiping as described above (e.g. a 5 to 30 inch break in the printed image for every 30 to 200 feet of printing), the deleterious effects of condensation can be readily ameliorated. In practice, images printed onto the web 3 have natural breaks for cutting the web; therefore, incorporating somewhat extended breaks in the image for web-wiping, as described above, has minimal practical impact on most print jobs.

It will, of course, be appreciated that the present invention has been described by way of example only and that modifications of detail may be made within the scope of the invention, which is defined in the accompanying claims.

The invention claimed is:

1. A printer comprising:

a platen comprising a plenum chamber having an apertured platen surface;

a printhead assembly comprising at least one inkjet printhead operatively positioned opposite the platen;

a feed mechanism for feeding a web of print media over the platen and along a printing feed path; and a gas source connected to the plenum chamber;

a controller configured for periodically providing a pulse of positive gas pressure from the gas source to the plenum chamber, thereby periodically diverting a portion of the web towards the printhead assembly and along a maintenance feed path, wherein the portion of the web diverted along the maintenance feed path wipes part of the printhead assembly.

2. The printer of claim 1, wherein the feed mechanism continuously feeds the web past the printhead when the portion of the web is diverted along the maintenance feed path.

3. The printer of claim 1, wherein the portion of the web fed along the maintenance feed path contacts a lowermost part of the printhead assembly.

4. The printer of claim 3, wherein the lowermost part of the printhead assembly comprises an encapsulant material immediately downstream of a respective printhead, the encapsulant material encapsulating data and power connectors for the printhead.

5. The printer of claim 1, wherein the portion of the web fed along the maintenance feed path does not contact a nozzle plate of the printhead.

6. The printer of claim 1, further comprising a vacuum source connected to the plenum chamber.

7. The printer of claim 6, wherein the controller is configured for periodically interrupting a vacuum pressure in the plenum chamber with the pulse of positive gas pressure.

8. The printer of claim 1, wherein the controller is configured for providing the pulse of positive gas pressure with a predetermined pulsewidth and/or frequency.

9. The printer of claim 8, wherein the pulsewidth and/or frequency is dependent on one or more of:

a type of print media;

a speed of printing;

an image to be printed;

an ambient humidity;

an ambient temperature; and a type of ink supplied to the printhead.

10. The printer of claim 8, wherein the pulsewidth is in the range of 0.05 to 0.8 seconds.

11. The printer of claim 1, wherein the vacuum source and the gas source are connected to the plenum chamber via a multiway valve, the controller controlling the valve to connect either the vacuum source or the gas source to the plenum chamber.

12. A method of wiping part of a printhead assembly, the method comprising the steps of:

feeding a web of print media over a platen having an aperture plenum surface, the printhead assembly comprising at least one inkjet printhead positioned opposite the platen; and applying a pulse of positive gas pressure to the plenum chamber so as to lift a portion of the web away from the platen surface and divert the portion of the web along a maintenance feed path, wherein the portion of the web diverted along the maintenance feed path wipes part of the printhead assembly.

13. The method of claim 12 wherein the portion of web removes condensation from part of the printhead assembly.

14. The method of claim 12, wherein the wiped part of the printhead assembly is immediately downstream of a respective printhead.

15. The method of claim 12, wherein the web is moving when the positive gas pressure is applied to the plenum chamber.

16. The method of claim 12, wherein the pulse of positive gas pressure lifts the web from the platen surface by a distance in the range of 0.2 to 1 mm.

17. The method of claim 12, wherein the pulse of positive gas pressure interrupts a vacuum pressure in the plenum chamber.

18. The method of claim 12, wherein the web is continuously fed past the printhead assembly at a speed of at least 30 inches per second.

19. A printer comprising:

a platen;

a printhead assembly comprising at least one inkjet printhead operatively positioned opposite the platen;

a feed mechanism for feeding a web of print media over the platen and along a printing feed path; and a diverter configured for periodically diverting a portion of the web towards the printhead assembly and along a maintenance feed path, wherein the portion of the web diverted along the maintenance feed path wipes part of the printhead assembly but does not contact a nozzle plate of the printhead.

* * * * *